United States Patent [19]

March

[11] Patent Number: 4,785,944

[45] Date of Patent: Nov. 22, 1988

[54] COLLAPSIBLE DISPLAY AND DISPENSING DEVICE

[75] Inventor: David March, New York, N.Y.

[73] Assignee: Thomson-Leeds Company, Inc., New York, N.Y.

[21] Appl. No.: 88,385

[22] Filed: Aug. 24, 1987

[51] Int. Cl.[4] ..... A47F 7/00

[52] U.S. Cl. ..... 211/59.2; 211/72

[58] Field of Search ..... 211/126, 189, 195, 59.2, 211/72, 73, 193, 128, 94, 162; 312/45, 42; 248/174, 459; 229/122.1; 206/45, 44

[56] References Cited

U.S. PATENT DOCUMENTS

| | | | |
|---|---|---|---|
| 1,458,953 | 6/1923 | Robeson | 211/59.2 X |
| 1,576,420 | 3/1926 | Folts | 211/126 X |
| 1,931,403 | 10/1933 | Connor | 312/42 |
| 2,743,021 | 4/1956 | Glenn | 211/72 X |
| 3,528,558 | 9/1970 | Williams | 211/59.2 |
| 3,656,611 | 4/1972 | Mertz | 206/44 R |
| 4,519,319 | 5/1985 | Howlett | 206/45 |

*Primary Examiner*—Reinaldo P. Machado
*Assistant Examiner*—Sarah A. Lechok Eley
*Attorney, Agent, or Firm*—Howard C. Miskin

[57] ABSTRACT

A display and dispensing device includes a collapsible cardboard rack having a rear wall and hinged side walls provided with vertically spaced longitudinal recesses delineating forwardly projecting pairs of arms having track delineating top edges and cross pieces extending between and hinged at their opposite ends to the front ends of the arms of each pair. A shelf member having side channels slidably engaging each pair of tracks is supported by each pair of arms and has a rearwardly projecting apertured tab projecting through a respective opening in the rack rear wall and interlocked with a tongue located in the opening.

15 Claims, 6 Drawing Sheets

FIG. 3
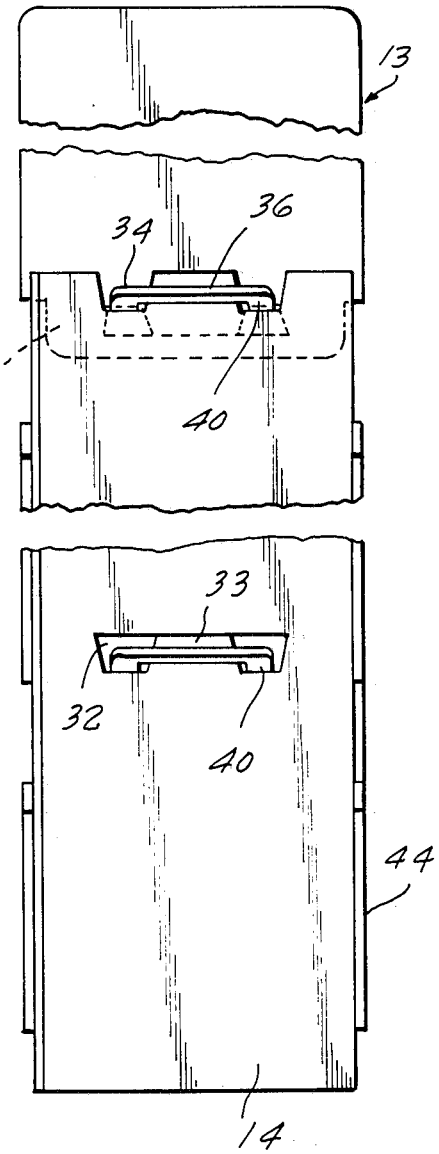
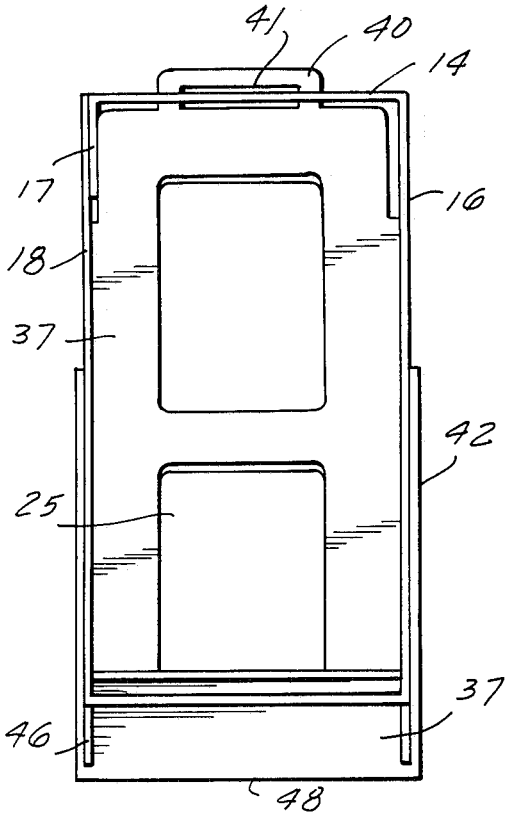
FIG. 4
FIG. 5
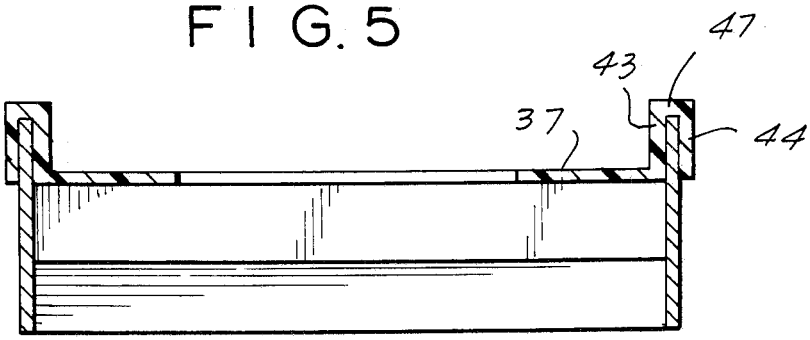

COLLAPSIBLE DISPLAY AND DISPENSING DEVICE

BACKGROUND OF THE INVENTION

The present invention relates generally to improvements in display and dispensing device and it relates particularly to an improved compactly collapsible multi-level display and dispensing device.

In the merchandising of prepackaged products, particularly in supermarkets and other retail establishments, the packaged product is generally displayed on and dispensed from shelves which are a permanent fixture. However, it is often desirable to display and dispense packaged products from areas other than the permanent shelves to either specially present the merchandised products, or to increase the available display space. To this end it has been a conventional practice to provide unassembled racks or shelf structures which may be assembled at the site and which are discarded after a short period of use. The unassembled display structures heretofore available, however, possess numerous drawbacks and disadvantages. They are difficult to assemble and erect, are of unattractive appearance, frequently bulky in their collapsed condition, of little versatility and adaptability and otherwise leave much to be desired.

SUMMARY OF THE INVENTION

It is a principal object of the present invention to provide an improved display and dispensing device.

Another object of the present invention is to provide an improved collapsible display and dispensing device which may be easily and rapidly erected and assembled without the use of any tools.

Still another object of the present invention is to provide a multi-level shelf structure which in its collapsed and unassembled condition is highly compact and easily packaged, stored, shipped and otherwise handled.

A further object of the present invention is to provide a device or structure of the above nature which is inexpensive, of highly attractive appearance, convenient and easy to assemble and use, rugged and of great versatility and adaptability.

The above and other objects of the present invention will become apparent from a reading of the following description taken in conjunction with the accompanying drawings which illustrate a preferred embodiment thereof.

A display and dispensing device in accordance with the present invention includes a vertical rack collapsible to a lay flat condition and in its erected state including a vertical rear wall and a plurality of vertically spaced pairs of laterally spaced arms projecting forwardly from the rear wall side edges and having parallel coplanar track defining top edges and a shelf member supported by each pair of arms and including a base section and downwardly open parallel longitudinal channels extending along the base section side edges and longitudinally slidably engaging respective tracks and couplings interlocking the shelves and the rack to restrict longitudinal movement of the shelf members.

In the preferred form of the improved display device the rack is formed of a unitary cardboard blank and includes forwardly projecting side walls self hinged to the rear wall side edges, the side walls having recesses in their forward portions delineating vertically spaced arms with forwardly downwardly inclined track defining top edges, the front ends of each pair of arms being connected by a cross piece connected at its opposite ends by hinges to permit the collapse of the rack and its extension to an erect condition. Vertically spaced medially located openings are formed in the rack rear wall and resilient coupling tongues integrally formed with the rear wall register with each rear wall opening. Each shelf member is integrally formed of a synthetic organic polymeric material and includes a flat substantially rectangular base with the channels extending from the front edge thereof and projecting above the base. An apertured coupling tab medially rearwardly projects from each shelf base and is engaged by a respective rack coupling tongue, the coupling tongue and tab being interlocked by sliding the shelf member rearwardly on the tracks so that the tab rearwardly flexes and then releases the coupling tongue to engage the tab aperture.

The improved display and dispensing device is inexpensive, rugged, of attractive appearance, compact in its collapsed state, easily and rapidly assembled and erected without tools and of great versatility and adaptability.

BRIEF DESCRIPTION OF THE DRAWINGS

FIG. 3 is a fragmented rear view of the erected device;

FIG. 4 is a bottom view thereof;

FIG. 5 is a sectional view taken along line 5—5 in FIG. 2;

DESCRIPTION OF THE PREFERRED EMBODIMENT

Figure 1:
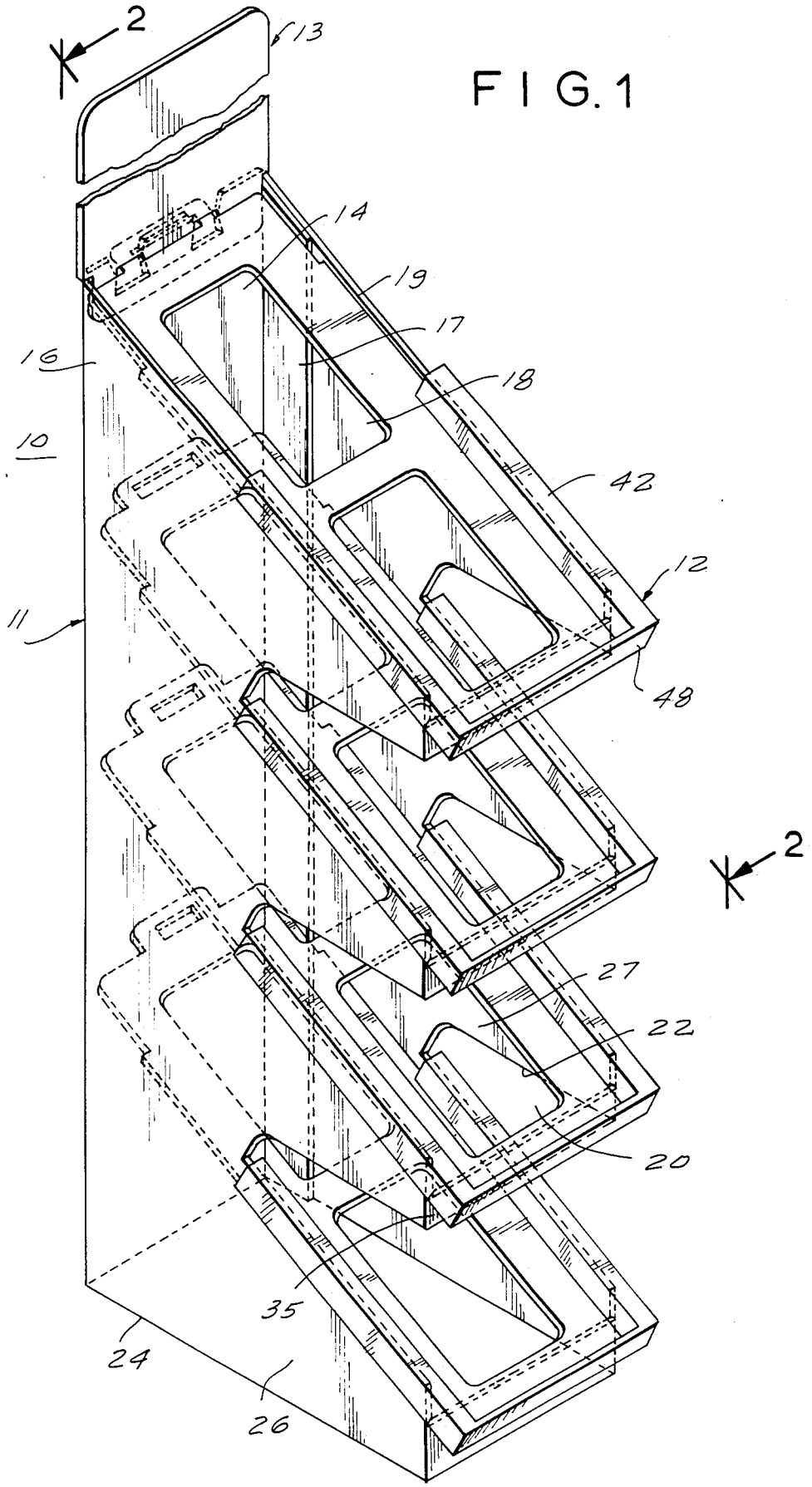
FIG. 1 is a front perspective view of a display device embodying the present invention and shown in an assembled erected condition.
Figure 2:
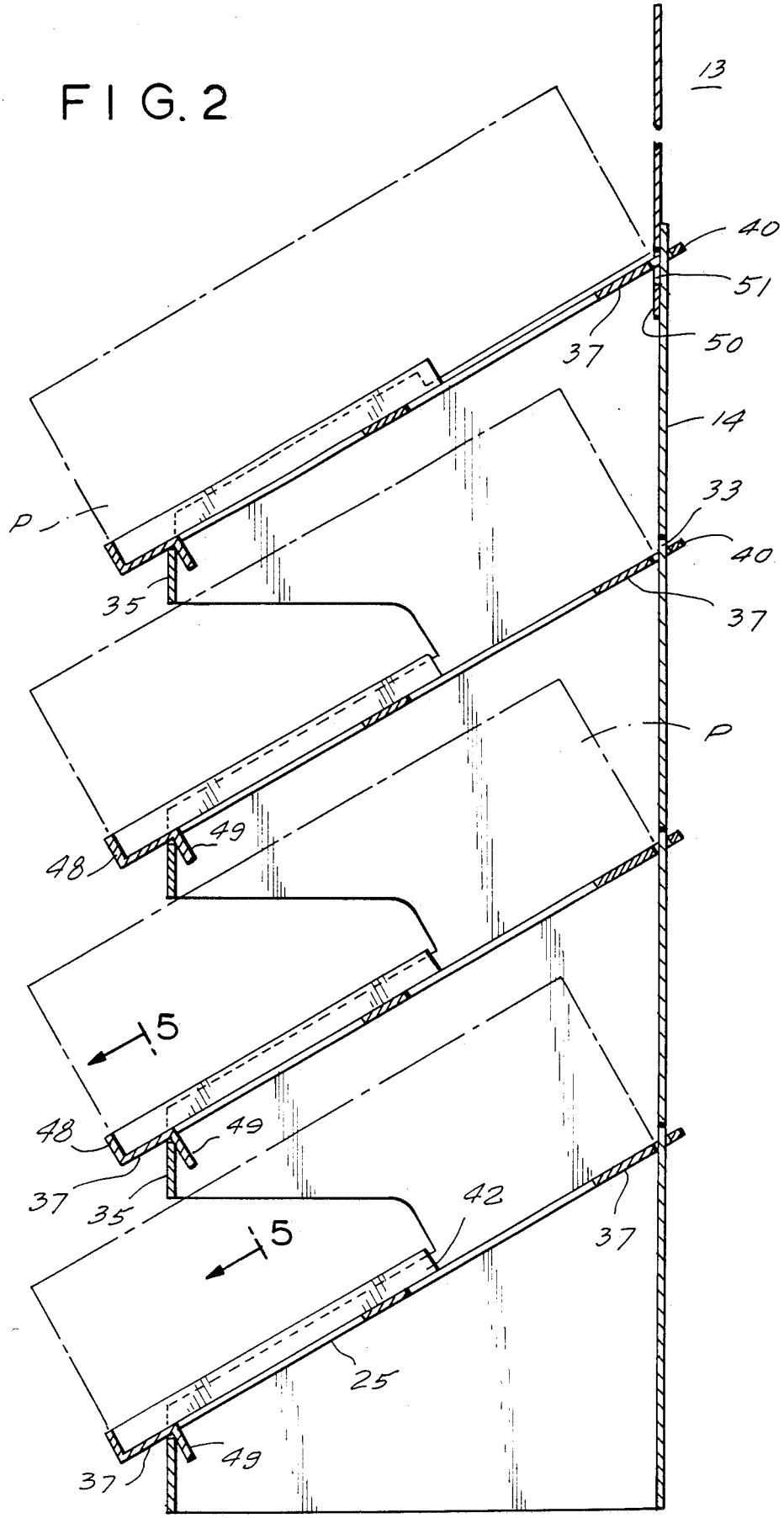
FIG. 2 is a sectional view taken along line 2—2 in FIG. 1.

Referring now to the drawings which illustrate a preferred embodiment of the present invention, the reference numeral 10 generally designates the improved display and dispensing device which is illustrated as a four shelf structure, it being understood that it may be of a construction containing more or less than four shelves. Display device 10 includes a collapsible rack 11, a plurality of, in the illustrated example four, shelf members 12 and a display card 13.

The rack 11 is formed from a unitary blank of any suitable material, preferably cardboard, particularly corrugated cardboard, and in its erected state includes a substantially rectangular vertical rear wall 14. Projecting forwardly from one vertical side edge of rear wall 14 and self hinged thereto is a first vertical side wall 16 and projecting forwardly from the other vertical side edge and self hinged thereto is a flap 17 coextensive with tee height of rear wall 14. A second side wall 18 similar and parallel to first side wall 16 is glued along its rear border to flap 17 so, like side wall 16, as to be swingable about the respective side edge of rear wall 14.

The top edges 19 of side walls 16 and 14 are forwardly downwardly inclined. Formed in the forward portions of side walls 16 and 18 are regularly vertically spaced recesses 20, three in the illustrated embodiment, each recess extending rearwardly to approximately to the vertical medial axis of the respective side wall and including a track defining forwardly downwardly inclined bottom edge 21 parallel to side wall top edge 19 and approximately horizontal top edge 22 joined at its rear to bottom edge 21 by a vertically downwardly extending rear edge 23. The bottom edges 24 of side walls 16 and 18 are horizontal and with the next successive recess edge 21 delineates a forwardly projecting bottom arm 26. The top edge 22 of each recess 20 and the bottom edge of each next successive recess delineate forwardly projecting arms 27 and the top edges of the uppermost recesses 20 and the top edges of side walls 16 and 18 delineate forwardly projecting arms 28, the arms 26, 27 and 28 in each wall 16 and 18 are similar and parallel to the corresponding arms in the opposite side wall. Each of the arms 26, 27 and 28 terminate at the front in a vertical edge 29, the vertical edges 29 of laterally opposite arms being joined at their lower portions by laterally extending vertical cross pieces 35 self-hinged at their opposite ends to respective edges 29.

Formed in rear wall 20 are regularly vertically spaced medially located laterally extending openings 32, which intersect the planes of pairs of laterally spaced track defining edges 21. Projecting medially upwardly from the bottom edge of each opening 32 and integrally formed therewith is an upwardly projecting resilient coupling tongue 33 normally coplanar with rear wall 14 and being of trapezoidal shape with converging side edges and horizontal top edges proximate the top edges of openings 32. Formed in the top edge of rear wall 14 are a pair of laterally spaced recesses which delineate a trapezoidal resilient coupling tongue 36 similar in shape to coupling tongues 33.

The shelf members 12 are formed of any suitable material such as a synthetic organic polymeric resin by injection molding or other method. Each shelf member 12 includes a substantially rectangular flat base 37 of a width approximately equal to the distance between the inside opposing faces of rack side walls 16 and 18 and of a length somewhat greater than the distance along a plane parallel to opposite tracks 21 between rear wall 14 and cross pieces 35. The side edges 38 of base 37 are contracted at their rears to rear side edges by an amount approximately equal to the thickness of flap 17, edges 39 being somewhat longer than the width of flap 17. Projecting medially rearwardly of and coplanar with base 37 is a rectangular coupling tab 40 having a laterally extending rectangular coupling opening or slot 41. Formed in base 37 are front and rear rectangular openings 25.

Extending rearwardly along the front portions of base side edges 38 from the front edge thereof and projecting upwardly from base 37 are opposite parallel open bottom channel members 42, each having vertical parallel inside and outside walls 43 and 44 delineating a longitudinal channel 46 the walls 43 and 44 being joined at their tops by top walls 47. A front end wall 48 extends along the front edge of base 37 between channel member outside walls 44. Depending from base 37 and extending between side edges 38 along the front edge of base front opening 25 is a flange 49. The distance between front face of flange 49 and coupling opening 41 is approximately that between cross piece 35 and rack rear wall 14 along the plane of tracks 21.

The display card 13 is of rectangular shape and of a width equal to the distance between the outside faces of rack side walls 16 and 18. Medially depending from and coplanar with card 13 is a coupling tab of 50 a width about equal to the distance between the inside faces of side walls 16 and 18 and having formed therein a transverse rectangular opening 51. A resilient trapezoidal coupling tongue 52 medially depends from and is joined to the upper edge of openings 51 and extends substantially to the bottom edge thereof.

Figure 10:
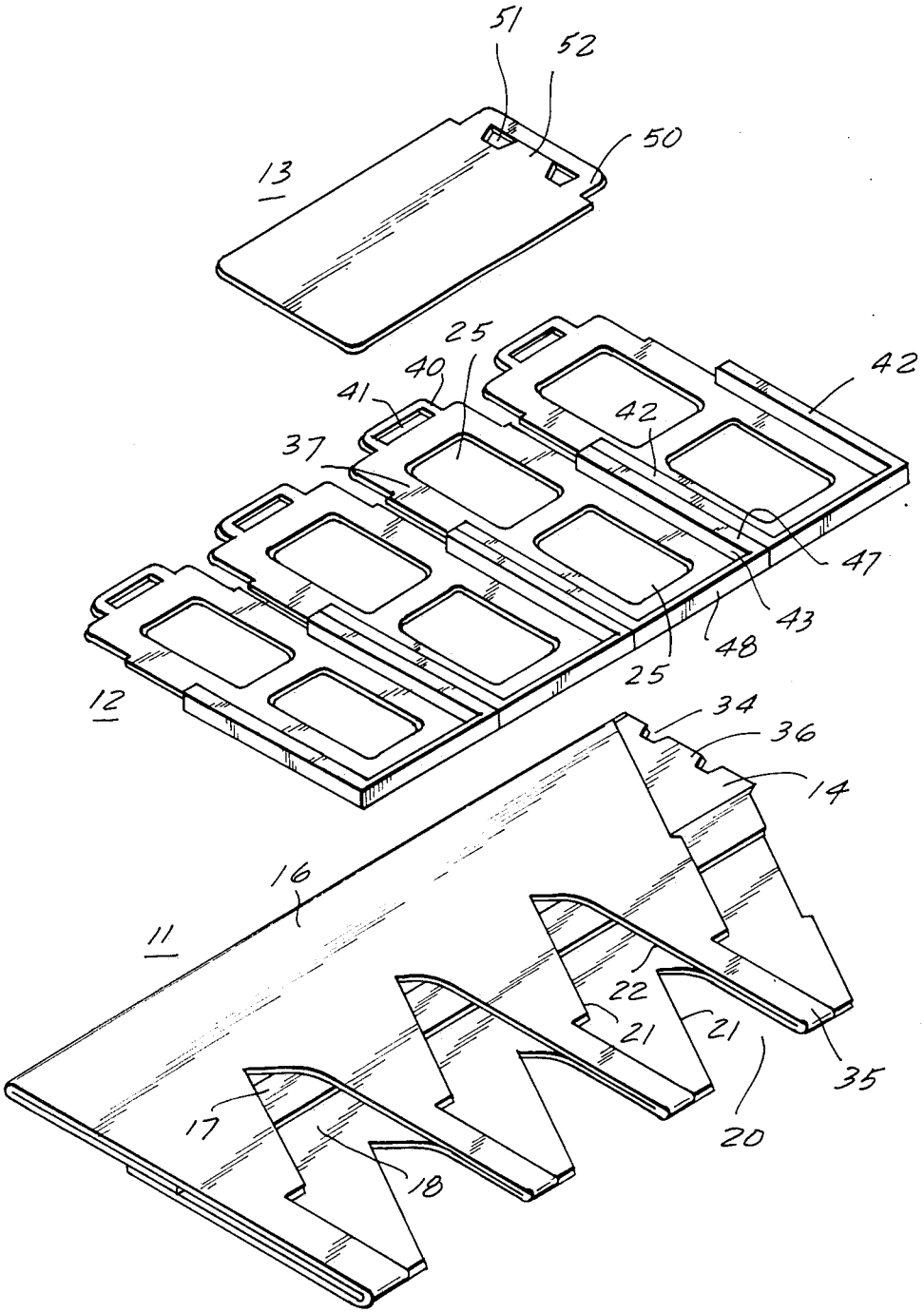
FIG. 10 is an exploded perspective view of the improved device in a collapsed condition.

In the collapsed condition of the device 10, rack 11, shelf members 12 and display card 13 are separate, the rack 11 is folded along the vertical self hinges to a lay flat condition as shown in FIG. 10 and the shelf members 12 are arranged side-by-side and superimposed on the collapsed rack as is the display card 13 in which arrangement the collapsed device is conveniently compactly packaged for shipping and storing.

Figure 6:
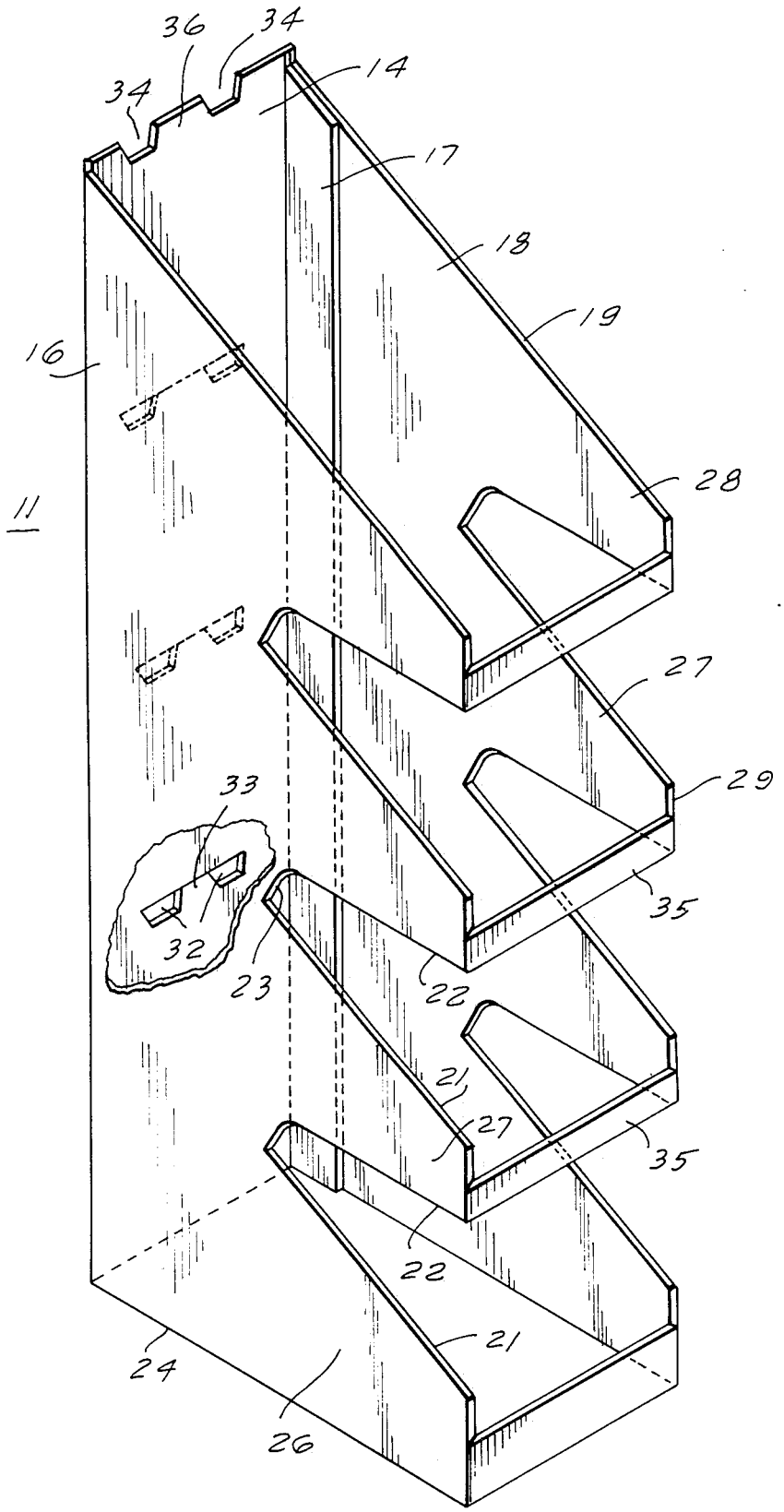
FIG. 6 is a front perspective view, partially broken away, of the erected rack portion of the display device.
Figure 7:
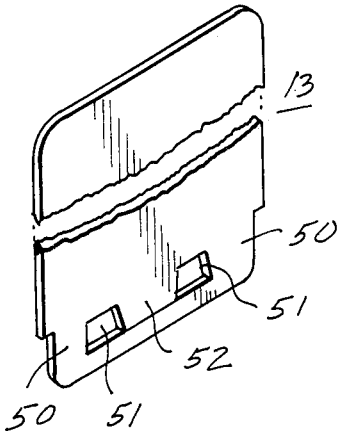
FIG. 7 is a fragmented front perspective view of a display card portion of the device.
Figure 8:
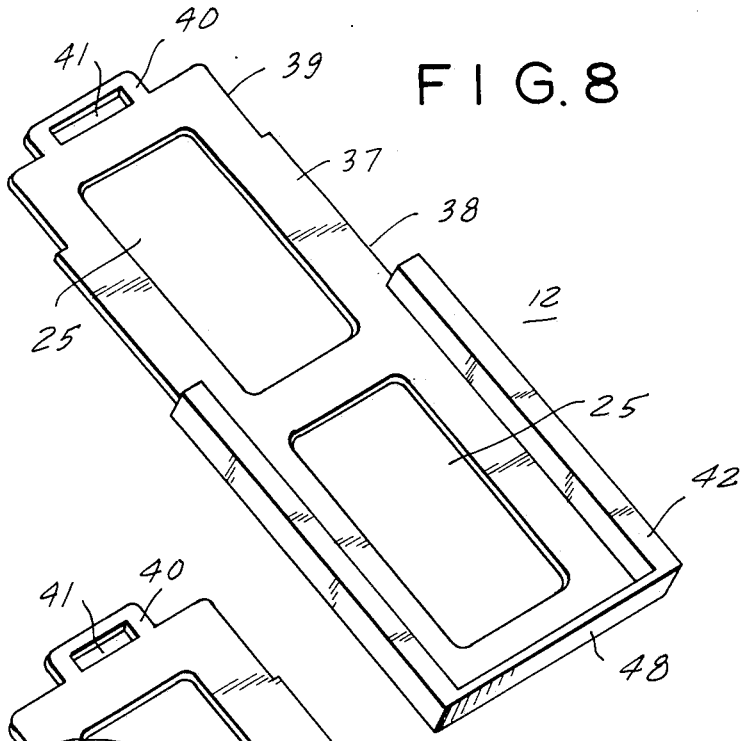
FIG. 8 is a top perspective view of a shelf member forming part of the improved device.
Figure 9:
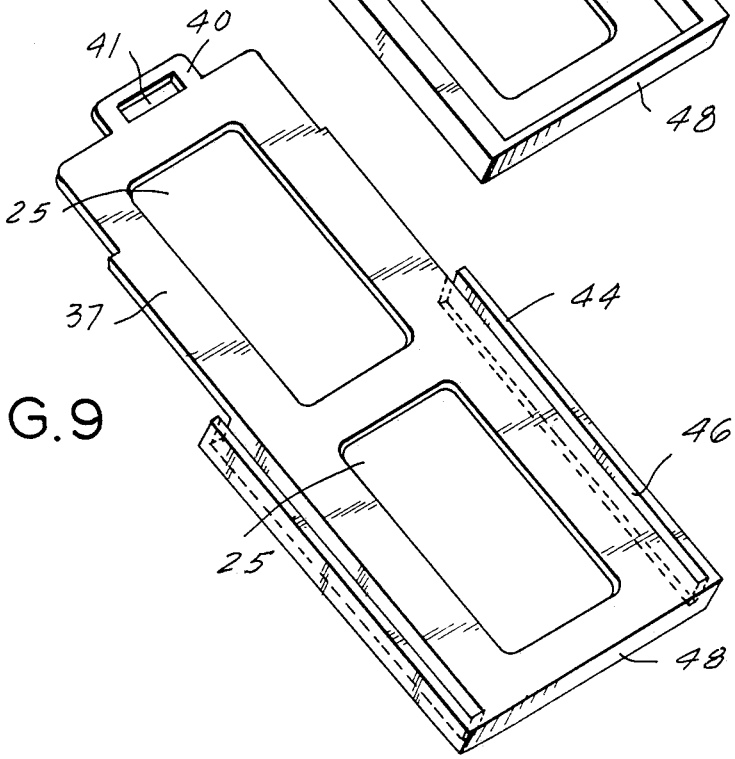
FIG. 9 is a bottom perspective view of the shelf member.

In assembling and erecting the display and dispensing device 10, rack 11 is extended or squared up by swinging the walls thereof about their hinges until they are in quadrature at vertical 90° dihedral angles as shown in FIG. 6. A first shelf member 12 is placed on the bottom pair of tracks and slide rearwardly with channels 46 engaging respective tracks 21 to project tab 40 through a rear wall coupling opening 32 the rear edge of tab 40 flexing and then releasing coupling tongue 33 into engagement with tab opening 41 to interlock the respective shelf member 12 and the rack rear wall 14, the tab resting on the bottom edge of the opening 32. The shelf member 12 is then depressed to bring the channels 46 in snug engagement with tracks 21 and the junction line of flange 49 and the front border of shelf member base into engagement with the top edge of lowermost cross piece 35. The next upwardly successive two shelf members are similarly assembled to the rack in the manner described above.

In assembling the display card 13 top most shelf member 12 and rack 11, after the three lower shelf number have been applied, the tab 40 of the fourth shelf member is inserted through card coupling opening 51 to bring tongue 52 into locking engagement with tab opening 41. The card tab 50 is slid forwardly along shelf member tab 40 and is then inserted along the front face of rack rear wall 14 until the rear wall top tongue engages shelf member tab opening 41 behind tongue 52. The channels 46 are pressed into engagement with top tracks 19 and flange 49 inserted behind top cross piece 35 thus completing the assembly and erection of device 10. The device 10 may be disassembled and collapsed in a manner opposite to that described above.

The assembly and erection of the display and dispensing device are simple and rapid nd require no tools and the assembled device is firm and rugged and of attractive appearance, the structure being reinforced by the interlocking and cooperation of the various components. The display card and rack may be decorated and carry any desired information.

Any desired product tray or package of suitable size may be removably supported in the shelf members, resting on and slidable along the side borders of respective shelf member bases 37 and confined thereon by the rack side walls 16 and 18 and the channel members 42.

While there has been described and illustrated a preferred embodiment of the present invention it is apparent that numerous alterations, additions and omissions may be made without departing from the spirit thereof.

I claim:

1. A display device comprising a vertical rack collapsible to a lay flat condition and including a vertically extending rear wall and a plurality of vertically spaced pairs of laterally spaced arms hinged to and projecting forwardly from respective opposite edges of said rear wall, the arms of each pair having bottom edges and parallel coplanar track defining forwardly downwardly inclined top edges and a shelf member supported by each pair of said arms in a forwardly downwardly inclined position and including a base section having laterally spaced side edges and downwardly open channel sections extending along said side edges and longitudinally slidably embracing respective tracks of a respective pair of arms, and coupling means interconnecting said shelves and said rack to restrict the longitudinal movement of said shelf member, said arm bottom edges being spaced above the directly underlying shelf member.

2. The display device of claim 1 wherein said coupling means is responsive to the sliding of a respective shelf along the shelf channel engaged tracks to a rearmost position.

3. The display device of claim 2 wherein each of said coupling means comprises a laterally extending medial opening formed in said rack rear wall across the plane of a respective pair of tracks and a resilient vertically extending tongue joined at its base to a laterally extending border of said opening and a tab projecting rearwardly from said shelf base and having an aperture engaged by said tongue.

4. The display device of claim 1 including a cross piece extending laterally between and hinged at its opposite ends to the forward end edges of a respective pair of said rack arms.

5. The display device of claim 4 wherein each of said shelf members includes a laterally extending flange depending from said shelf member base section rearwardly of the forward edge thereof, a respective cross piece engaging the bottom forward junction of said flange and base section.

6. The display device of claim 1, said rack including vertically extending laterally spaced side walls hinged at their rear edges to respective side edges of said rear wall and having vertically spaced recesses formed in the front portions thereof, said recesses having bottom edges defining said tracks and having top edges delineating the bottom edges of said arms.

7. The display device of claim 6 including vertically spaced coplanar cross pieces parallel to said rear wall and extending laterally between and hinged at their opposite ends to the lower front edges of respective arms.

8. The display device of claim 6, said rack rear wall having vertically spaced medially located openings formed therein said coupling means including resilient tongues registering with said openings.

9. The display device of claim 1 wherein the base section of each of said shelf members is flat and said channel sections extend from the front of and project above said base section and terminate short of the rear thereof.

10. The display device of claim 9 wherein said channel sections have bottom openings substantially coplanar with the respective base section.

11. The display device of claim 10 wherein said shelf member includes an upwardly directed vertical flange extending along the front edge of said shelf member.

12. The display device of claim 9 wherein said coupling means includes a tab coplanar with and projecting medially rearwardly from said base section and has a coupling opening formed therein.

13. The display device of claim 1 wherein said rack is formed of a unitary cardboard blank.

14. The display device of claim 1 wherein each of said shelf members is an integrally formed unit molded of a synthetic organic plastic material.

15. The display device of claim 3 further comprising a display card projecting upwardly from said rack rear wall and including a depending coupling member engaging said tab of the uppermost shelf member.

* * * * *